US005189840A

United States Patent [19]

Yanagizawa et al.

[11] Patent Number: 5,189,840

[45] Date of Patent: Mar. 2, 1993

[54] DEVICE FOR HOLDING SLIDABLE MEMBER

[75] Inventors: Hirofumi Yanagizawa; Katsuhiko Oikawa, both of Moriyama; Shigeru Nakamura, Kanagawa; Yoshinori Kamiya, Sagamihara, all of Japan

[73] Assignees: Gunze Limited, Ayabe; Nissan Motor Co., Ltd., Kanagawa, both of Japan

[21] Appl. No.: 744,037

[22] Filed: Aug. 12, 1991

[30] Foreign Application Priority Data

Aug. 13, 1990 [JP] Japan ..... 2-214787
Sep. 25, 1990 [JP] Japan ..... 2-256414

[51] Int. Cl.[5] ..... E06B 7/16
[52] U.S. Cl. ..... 49/493; 49/377; 49/475.1
[58] Field of Search ..... 49/377, 475, 493; 264/27; 57/238

[56] References Cited

U.S. PATENT DOCUMENTS

| | | | |
|---|---|---|---|
| 2,448,782 | 9/1948 | Davis | 57/238 X |
| 3,419,059 | 12/1968 | Bridge, Jr. | 57/238 X |
| 3,590,570 | 7/1971 | Okuhashi | 57/238 |
| 3,836,421 | 9/1974 | Terry, Jr. et al. | 49/475 X |
| 3,944,693 | 3/1976 | Ungerer | 49/475 X |
| 4,352,845 | 10/1982 | Miska | 49/475 X |
| 4,526,735 | 7/1985 | Norota et al. | 264/27 |

FOREIGN PATENT DOCUMENTS

| | | | |
|---|---|---|---|
| 830382 | 3/1960 | United Kingdom | 57/238 |

*Primary Examiner*—Philip C. Kannan
*Attorney, Agent, or Firm*—Armstrong, Westerman, Hattori, McCleland & Naughton

[57] ABSTRACT

A slidable member holding device having a flock portion for contact with a member slidable relative thereto. The flock portion comprises a yarn including as its components at least two kinds of filaments having different thicknesses, and is improved in slipping property, abrasion resistance and durability.

14 Claims, 3 Drawing Sheets

FIG. 4
PRIOR ART
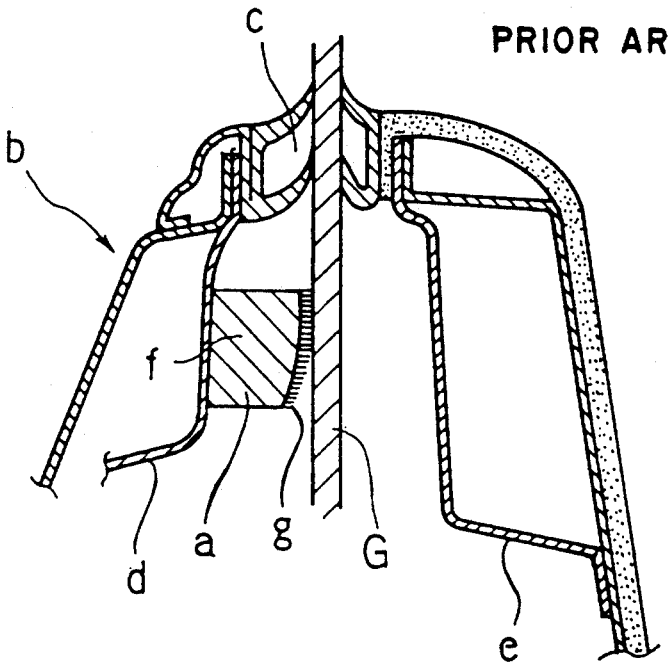
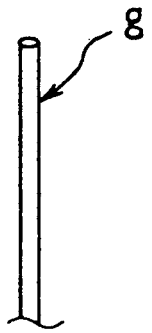
FIG. 5
PRIOR ART

DEVICE FOR HOLDING SLIDABLE MEMBER

TECHNICAL FIELD

The present invention relates to a device for holding a member slidable relative to the device in contact therewith, and more particularly a sliding member holding device which permits such a member to move relative thereto smoothly in sliding contact therewith and which has high abrasion resistance and is free of the likelihood of defacing the member by the sliding contact.

BACKGROUND ART

For example in motor vehicles, the window glass panels of doors are usually slidable relative to other door members. Especially vehicles having sashless doors have means for preventing the vibration of the window glass panel during driving or when the door is opened or closed. For example, FIG. 4 shows a window glass stabilizer a serving as a holding device and fixed in the vicinity of the waist opening c within the door body b to a portion which comes into sliding contact with a window glass panel G, i.e., to the outer reinforce d or inner reinforce e. The stabilizer is adapted for sliding contact with the movable window glass panel G to suppress the vibration of the glass panel G.

The window stabilizer a shown in FIG. 4 and already known (see Examined Japanese Patent Publication SHO 61-19446) has a base f made of rubber or like elastic material and flocked with fluorine-containing resin fibers, nylon fibers or like fibers g like the one shown in FIG. 5 to provide a surface for sliding contact with the window glass panel.

As the window glass panel is opened and closed an increasing number of times in contact with the stabilizer of the above structure heretofore in use, the flock collapses to a film form to contact the glass panel over an increased area. If the window glass panel is opened and closed with sand, dust or the like adhering thereto in this state, the sand, dust or like deposit becomes caught between the glass panel and the flock in the form of a film, defacing the glass panel or giving off disagreeable noise. Especially, this problem is liable to occur, for example, when the glass surface has water and volcanic ash adhering thereto. It is therefore important to solve the problem.

DISCLOSURE OF THE INVENTION

We have conducted investigations repeatedly to overcome the foregoing problem and provide a device for holding a slidable member which device permits the member to slidingly move relative thereto with a deposit adhering to the member without defacing the member, the device having a flock providing a slippery surface, exhibiting high abrasion resistance and less prone to collapsing. Consequently we have reached the conclusion that the above problem can not be solved insofar as fibers of a uniform thickness are used for forming the flock. On the other hand, we have found that the problem can be overcome by forming filaments of different thicknesses into a yarn and preparing a flock from the yarn. Thus, the present invention has been accomplished.

The present invention provides a slidable member holding device having a flock portion for contact with a member slidable relative to the device, the device being characterized in that the flock portion comprises a yarn including as its components at least two kinds of filaments having different thicknesses. The expression "a member slidable relative to the device" means that at least one of the slidable member and the holding device is movable relative to the other.

The holding device of the present invention has the advantages that it is more slippery than conventional devices, is greatly reduced in the likelihood of defacing the member slidable relative thereto and has such high ability to elastically restore itself that the flock portion is resistant to collapsing and less prone to phenomenon of setting. Moreover, the device has high abrasion resistance and is therefore greatly diminished in the likelihood that particles of worn fibers or like extraneous matter will adhere to the surface of the slidable member. Thus, the present device is more excellent than the conventional device in every respect.

Because of these features, the device of the present invention is least likely to produce disagreeable noise, for example, when used for window glass panels and is expected to find wider use.

BRIEF DESCRIPTION OF THE DRAWINGS

FIG. 4 is a diagram for illustrating a stabilizer as a conventional holding device; and FIG. 5 is an enlarged view of a filament for forming the flock portion of the device.

BEST MODE OF CARRYING OUT THE INVENTION

The present invention will be described below in greater detail with reference to FIGS. 1 to 3.

Figure 1:
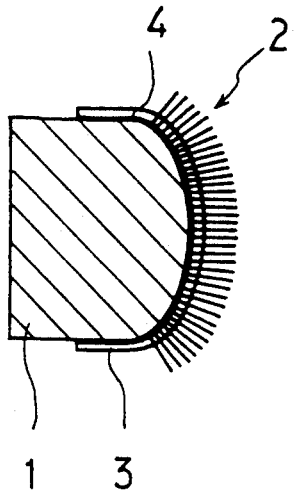
FIG. 1 is a sectional view of a stabilizer as an example of holding device of the invention.
Figure 2:
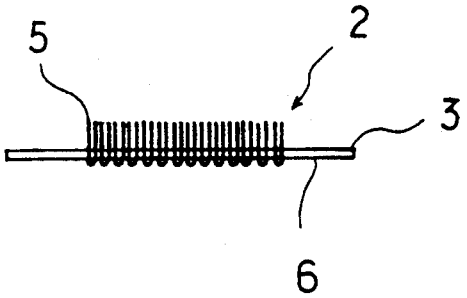
FIG. 2 is a sectional view showing a flock portion of the device.

FIG. 1 shows a holding member, i.e., a window glass panel stabilizer, which comprises a base 1 of elastic material, synthetic resin or the like, and a flock portion 2 providing a surface for contact with a window glass panel as a member slidable relative to the device. The flock portion 2 may be formed on a ground fabric 3, such as a woven fabric, or affixed directly to the base 1 with an adhesive. The ground fabric 3 may be bonded to the base 1 as with an adhesive 4, but when required, a cushioning member, such as felt, may be interposed therebetween without any particular limitation. The flock portion 2 may be formed on the woven fabric or like ground fabric 3 by flocking the ground fabric directly with loops of filaments, short fibers or the like with an adhesive without any particular limitation, whereas the following method is generally desirable. With reference to FIG. 2, the fiber for forming the ground fabric 3 and the yarn for forming the flock portion 2 are woven or knitted into a pile fabric so as to form a pile with the yarn, and the loops formed are cut to make a cut pile 5 and prepare the flock portion. The woven or knitted fabric may be of the single or double type. When required, the side 6 of the fabric opposite to the pile side may be set with a suitable resin, adhesive or the like to effectively prevent the tufts of the flock portion from slipping off. The fiber for forming the ground fabric 3 is not limited specifically but can be polyester, polyamide, polypropylene or like synthetic fiber or any of various other fibers. Although the setting resin or adhesive is not limited specifically, useful examples are those of the acrylic or vinyl acetate type, which preferably have heat resistance. While the cut pile structure has been described above, also included in the present invention is a knitted or woven pile fabric of the single type having uncut loops.

Although the height of the flock portion 2 is widely variable and is not limited specifically, it is suitable that the height be usually about 5.0 to about 6.5 mm.

Examples of filaments for use in the present invention are sythetic fibers, chemical fibers, natural fibers, etc., among which preferable are synthetic fibers of polyethylene, polypropylene and like polyolefins, nylon 6, nylon 66 and like polyamides, polyethylene phthalate, polybutylene terephthalate and like polyesters, polyvinyl chloride, polyacrylonitrile, fluorine-containing resins, etc. Especially preferable are filaments of fluorine-containing resins. Examples of such fluorine-containing resins are tetrafluoroethylene-perfluoroalkyl vinyl ether copolymer (hereinafter referred to as "PFA"), ethylene-tetrafluoroethylene copolymer, tetrafluoroethylene-hexafluoropropylene copolymer, vinylidene fluoride polymer, chlorotrifluoroethylene polymer, polytetrafluoroethylene and the like, among which PFA is most suitable. When such filaments of fluorine-containing resin are to be used according to the invention, a yarn must be prepared with use of at least two kinds of filaments, i.e., a thick filament having a large cross sectional area as it is, and a thin filament having a small cross sectional area. (A) In this case, the filaments may include a filament or a plurality of filaments of PFA and a filament or a plurality of filaments of other fluorine-containing resin. The method of preparing the yarn is not limited specifically; the desired yarn may be prepared, for example, by doubling and twisting, covering or doubling. The yarn may be prepared by doubling and twisting stepwise. When a covering yarn is to be prepared, it is preferable to use the thick filament as the core. The thick filament, as well as the thin filament, in the form of a single filament is not specifically limited in cross sectional area but may have a suitable area. When the filaments to be used are circular in cross section, the thin filament is 5 to 100 preferably 20 to 50$\mu$, in diameter, and the thick filament is 30 to 300$\mu$, preferably 50 to 300$\mu$, more preferably 80 to 200$\mu$, in diameter. These are merely exemplary values and are of course not limitative.

These filaments are used in combination in the form of a monofilament and/or a multifilament. The overall thickness of the multifilament is irrelevant to the concept of thick filament or thin filament of the invention. (B) When such multifilament is to be used, the multifilament may include a filament or a plurality of filaments of PFA and a filament or a plurality of filaments of other fluorine-containing resin.

Although the total number of filaments for forming the yarn is not limited specifically, an excessively large number of filaments make too thick a yarn or, conversely, an insufficient number of filaments make too thin a yarn, possibly producing an adverse effect on the formation of the flock portion, so that the number is determined usually from the range of about 50 to about 150 although dependent on the diameter of filaments.

The ratio of the thin filaments to the thick filaments in the total number of filaments is, for example, about 5 to about 80 thin filaments per thick filament.

In the case where the yarn includes a plurality of thin filaments and/or a plurality of thick filaments, the plurality of filaments may be of the same diameter or a mixture of filaments of different diameters.

Since the yarn is made of at least two kinds of filaments which are different in thickness, the yarn is more resistant to pressure, restores itself more satisfactorily when relieved of the pressure, is less susceptible to setting and has higher abrasion resistance than the yarn prepared from filaments of the same diameter. This is attributable to the abrasion resistance and elasticity afforded by the thin filament (generally low in denier value) and to the presence of the thick filament (generally high in denier value) which compensates for the defective low resistance of the thin filament to collapsing. (Since the denier value is relevant to the density of filaments, the thin filament is not always of low denier value when stated strictly, but in the case of filaments made of the same material, thinner filaments are of lower denier value.)

An example of the present invention is given below, and the stabilizer prepared was compared with those of comparative examples in quality and properties.

EXAMPLE 1

Design of Ground Fabric

Prepared with use of spun Tetoron yarns, i.e., two warp yarns of 30 count and two filling yarns of 40 count. 44 picks/in, 55 ends/in.

Design of Flock Portion

A doubled and twisted yarn was used which was prepared from PFA multifilament 1920 D/96 F (20 D×96 lengths, circular in cross section, each 36$\mu$ in diameter), and PFA monofilament, 450 D/3 F (150 D×3 lengths, circular in cross section, each 100$\mu$ in diameter), and set in an oven at 250° C. for 1 hour. 8 ends/cm, 11 picks/cm.

Based on the above design, a cut pile fabric was prepared by weaving a strip of moquette 5.5 mm in loop length, 31.0 mm in the width of ground fabric and 9.0 mm in the width of flock portion, and cutting the loops. The cut pile fabric was thereafter set (e.g., by processing with resin) using acrylic-styrene copolymer over one side thereof opposite to the pile side, then cut to a predetermined size and bonded to a base of elastic member with adhesive to prepare a stabilizer.

The doubled and twisted yarn 20 was prepared stepwise by twisting together two lengths of multifilament, 480 D/24 F (20 D×24 lengths), and a length of monofilament 22, 150 D, with 120 turns/m to obtain a thread 23 of 1110 D, and subsequently twisting together two lengths of thread 23 of 1110 D and a length of monofilament 24 of 150 D similarly with 120 turns/m (see FIG. 3).

COMPARATIVE EXAMPLE 1

A stabilizer was prepared in the same manner as in Example 1 with the exception of using PFA multifilament, 2400 D/72 F (33.3 D×72 lengths, circular in cross section, each 47$\mu$ in diameter) to form a 1 flock portion.

COMPARATIVE EXAMPLE 2

A stabilizer was prepared in the same manner as in Example 1 with the exception of using polytetrafluoroethylene multifilament, 2400 D/180 F (13.3 D ×180 lengths, circular in cross section, each 29$\mu$ in diameter), to form a flock portion.

The stabilizers were tested with the results to be described below.

1. Surface slipping property (JIS-K 7125)

| | Example 1 | | Comp. Ex. 1 | | Comp. Ex. 2 | |
|---|---|---|---|---|---|---|
| | μS | μD | μS | μD | μS | μD |
| DRY 23° C. × 60% RH | 0.24 | 0.24 | 0.23 | 0.28 | 0.31 | 0.37 |
| WET Glass panel wet with spray of water | 0.20 | 0.18 | 0.23 | 0.18 | 0.20 | 0.10 |
| WET + volcanic ash | 0.23 | 0.34 | 0.23 | 0.36 | 0.23 | 0.35 |

μS: coefficient of static friction

μD: Coefficient of dynamic friction

The above results indicate that the stabilizer of the invention is reduced in variations in coefficient of friction under the above conditions.

2. Elastic restorability (%)

| Weight | Example 1 | Comp. Ex. 1 | Comp. Ex. 2 |
|---|---|---|---|
| 10 kg g | 94 | 93 | 76 |
| 20 kg g | 85 | 81 | 70 |

The sample of flock portion was loaded with the above weight for 10 minutes, and the height of the flock was measured 24 hours later.

$$\text{Elastic restorability (\%)} = \frac{\text{Height after loading}}{\text{Height before loading}} \times 100$$

3. 20,000-Stroke sliding test (on dry glass surface)

| | State of glass surface | State of stabilizer flock portion |
|---|---|---|
| Ex. 1 | About 13,000 strokes produced some particles at opposide ends of glass surface due to wear of flock.<br>About 15,000 strokes produced no deposit or no film on the surface.<br>Film was locally formed by 20,000 strokes but readily removable. No noise or flaw. | Almost no wear resulted from 13,000 strokes.<br>Locally worn by 20,000 strokes.<br>Resistant to abrasion. |
| Comp. Ex. 1 | Particles appeared at opposite ends of the surface due to wear of flock after about 200 strokes.<br>No deposit or film was formed by 10,000 strokes.<br>Film was locally formed by 20,000 strokes but readily removable. No noise or flaw. | About 200 strokes started to abrade the flock.<br>The height was reduced to one-half by 10,000 strokes.<br>Locally worn by 15,000 strokes.<br>Complete wear of contact portion by 20,000 strokes. |
| Comp. Ex. 2 | Particles appeared at opposite ends of the surface due to wear of flock after about 200 strokes.<br>The entire surface became marked with brown lines after 5,000 strokes.<br>Stubborn brown deposit was formed over the entire surface by 20,000 strokes. No noise or flaw. | About 50 strokes completely collapsed the flock to a film form.<br>Resistant to abrasion. |

4. 3000-Stroke sliding test (on wet glass surface with dust)

| | State of glass surface | State of stabilizer flock portion |
|---|---|---|
| Ex. 1 | Several flaws in sliding direction | Resistant to collapsing, restored after removal of pressure |
| Comp. Ex. 1 | Several flaws in sliding direction | Resistant to collapsing, restored after removal of pressure |

-continued

| | State of glass surface | State of stabilizer flock portion |
|---|---|---|
| Comp. Ex. 2 | Flaws over entire surface | Completely collapsed, unrestorable after removal of pressure |

This test was conducted by moving a glass panel in contact with the stabilizer which was fixed.

Figure 3:
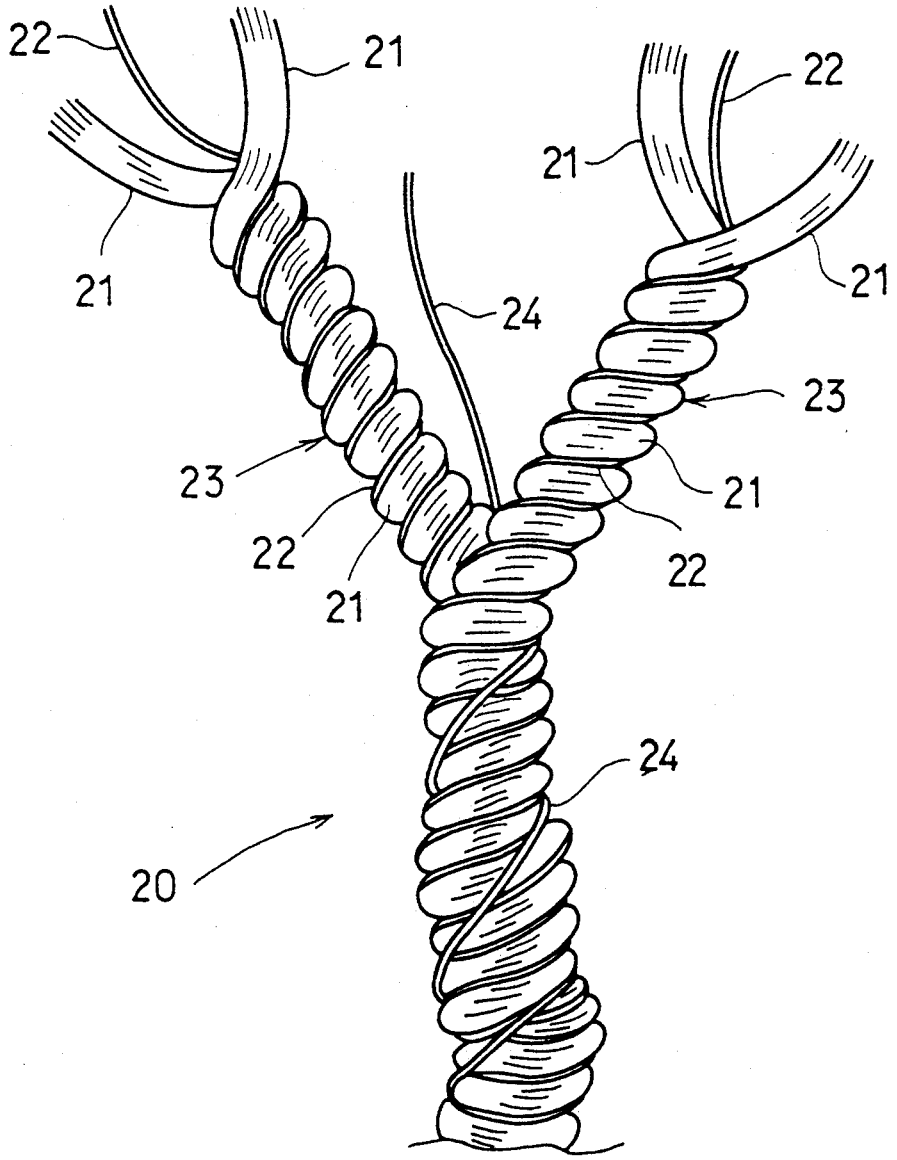
FIG. 3 is an enlarged view of a yarn for forming the flock portion.

Since the yarn 20 of the invention is so shaped as shown in FIG. 3, the tufts do not contact with one another intimately but remain spaced apart from one another even if the flock portion 2 is loaded. Accordingly, the flock portion will not be easily deformed to a filmlike form unlike the conventional one.

Although the slidable member holding device embodying the invention and described above is a window glass stabilizer for doors of motor vehicles, the device of the invention is useful, for example, as a cleaning member for use in copying machines, printers, facsimile systems, etc. or as a brushing member for cleaning processes, printing processes, etc. These examples are not limitative; the invention is applicable to other holding devices for use with a member which is opposed thereto and movable relative thereto while being pressed on by the device.

We claim:

1. A slidable member holding device having a flock portion for contact with a member slidable relative to the device, the flock portion comprising a yarn including as its components at least two kinds of filaments having different thicknesses.

2. A device as claimed in claim 1 wherein the filaments are filaments of a fluorine-containing resin.

3. A device as claimed in claim 2 wherein the filaments are filaments of tetrafluoroethylene-perfluoroalkyl vinyl ether copolymer.

4. A device as defined in claim 1 wherein the filaments include at least one filament of tetrafluoroethylene-perfluoroalkyl vinyl ether copolymer and at least one filament of other fluorine-containing resin.

5. A device as defined in claim 1 wherein the yarn is selected from the group consisting of doubled and twisted yarn, doubled yarn, and covering yarn.

6. A device as defined in claim 1 which is a window glass stabilizer for use with a window glass parrel as the slidable member.

7. A device as defined in claim 1, further comprising a base, said flock portion being provided on said base for contact with said member slidable relative to the device.

8. A device as defined in claim 7, wherein said base comprises an elastic material.

9. A device as defined in claim 8, wherein said elastic material of said base comprises rubber.

10. A device as defined in claim 7, wherein said flock portion is affixed directly to said base with an adhesive.

11. A device as defined in claim 7, further comprising a felt cushioning member interposed between said flock portion and said base.

12. A device as defined in claim 11, wherein said flock portion is formed on a ground fabric, said ground fabric adhering to said base with said felt cushioning member therebetween.

13. A device as defined in claim 12, wherein a fiber forming said ground fabric and said yarn forming said flock portion are woven into a pile fabric so as to form a pile with said yarn, loops of said pile being cut to form a cut pile.

14. A device as defined in claim 13, wherein said ground fabric comprises at least one of polyester, polyamide, and polypropylene.

* * * * *